US005102501A

United States Patent [19]

Eber et al.

[11] Patent Number: 5,102,501

[45] Date of Patent: Apr. 7, 1992

[54] MULTIPLE LAYER FIBROUS WEB PRODUCTS OF ENHANCED BULK AND METHOD OF MANUFACTURING SAME

[75] Inventors: Robert J. Eber, Appleton, Wis.; Bruce W. Janda, New Milford, Conn.

[73] Assignee: James River-Norwalk, Inc., Norwalk, Conn.

[21] Appl. No.: 217,079

[22] Filed: Jul. 7, 1988

Related U.S. Application Data

[63] Continuation of Ser. No. 006,250, Jan. 12, 1987, abandoned, which is a continuation of Ser. No. 668,144, Nov. 5, 1984, abandoned, which is a continuation-in-part of Ser. No. 409,055, Aug. 18, 1982, Pat. No. 4,488,932.

[51] Int. Cl.[5] ..... D21H 27/38

[52] U.S. Cl. ..... 162/129; 162/111; 162/112; 162/130

[58] Field of Search ..... 162/9, 123, 125, 129, 162/130, 132, 133, 100, 111, 112, 113, 117, 182

[56] References Cited

U.S. PATENT DOCUMENTS

| | | | |
|---|---|---|---|
| 3,406,088 | 10/1968 | Stengle et al. | 162/125 |
| 3,798,122 | 3/1974 | Appel | 162/101 |
| 3,837,999 | 9/1974 | Chung | 162/101 |
| 3,839,143 | 10/1974 | Suckow | 162/123 |
| 3,994,771 | 11/1976 | Morgan et al. | 162/113 |
| 4,036,679 | 7/1977 | Back et al. | 162/9 |
| 4,166,001 | 8/1979 | Dunning et al. | 162/111 |
| 4,227,964 | 10/1980 | Kerr et al. | 162/9 |
| 4,376,012 | 3/1983 | Bergstrom | 162/123 |
| 4,409,065 | 10/1983 | Kasser et al. | 162/9 |
| 4,431,479 | 2/1984 | Barbe et al. | 162/9 |
| 4,443,297 | 4/1984 | Cheshire et al. | 162/101 |

FOREIGN PATENT DOCUMENTS

| | | | |
|---|---|---|---|
| 2165433 | 9/1972 | Fed. Rep. of Germany | 162/125 |

*Primary Examiner*—Peter Chin
*Attorney, Agent, or Firm*—Richard J. Gallagher; Thomas H. Whaley; William A. Aguele

[57] ABSTRACT

Absorbent paper products, such as towels, absorbent wipes, toilet tissue, facial tissue and the like fibrous webs of relatively high bulk, are produced by a method comprising the steps of treating hydrophilic cellulosie fibers to impart kinks, curls, bends, twists, to the fibers; dispersing the treated fibers in an aqueous forming medium, and wet-forming a stratified single-ply web constituted of at least one stratum of the treated fibers and at least one stratum of conventional paper-making fibers. The treating step may consist of wet or dry mechanical working, chemical treatment or a combination of mechanical and chemical treatments. The web forming step comprises preparing a first aqueous furnish of the treated fibers, preparing a second aqueous furnish of the conventional fibers, and concurrently depositing the two furnishes in contiguous layers on a moving foraminous support.

6 Claims, 2 Drawing Sheets

Figures 1, 2:
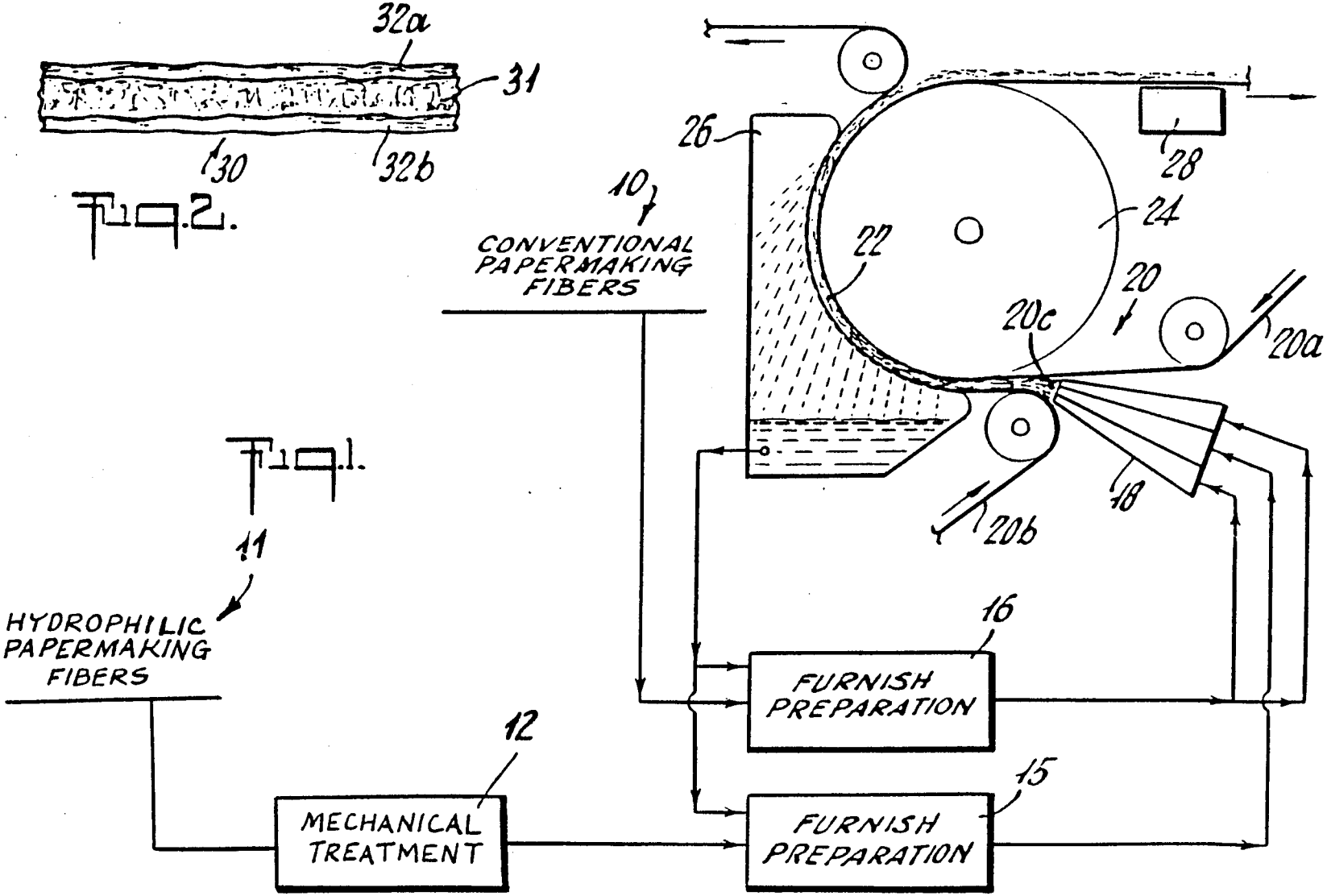

MULTIPLE LAYER FIBROUS WEB PRODUCTS OF ENHANCED BULK AND METHOD OF MANUFACTURING SAME

This is a continuation of application Ser. No. 07/006,250, filed Jan. 12, 1987, abandoned, which in turn, is a continuation of Ser. No. 668,144 filed on Nov. 5, 1984, abandoned, which is a continuation-in-part of Ser. No. 409,055 filed Aug. 18, 1982, now U.S. Pat. No. 4,488,932.

This invention relates to fibrous web products of enhanced bulk and superior formation containing one or more layers of conventional papermaking fibers in combination with one or more layers of deformed hydrophilic papermaking fibers, i.e. fibers characterized by kinks, twists, curls, crimps, or other deformations, referred to herein as treated fibers or bulk enhancing fibers, and to a method of and apparatus for making such fibrous web products.

In one of its more specific aspects, this invention relates to a method for the production of fibrous web products of enhanced bulk and superior formation as compared with conventional products by a wet papermaking process in which treated hydrophilic papermaking fibers are effectively utilized to provide improved bulk enhancement to a stratified product web. In another of its more specific aspects, the present invention relates to an improved process for the production of stratified high bulk fibrous web product wherein treated fibers and conventional papermaking fibers, are separately dispersed in a foamed aqueous medium providing two separate fiber furnishes which are dispensed separately onto a moving foraminous forming means, preferably a twin wire papermaking machine, producing a stratified wet web. The stratified wet web is then dried in a conventional manner. The resulting product has enhanced softness, absorbency and bulk as a result of the inclusion of a separate layer of treated fibers incorporated in the product.

In the manufacture of fibrous webs, for example, paper web products, including towel and bathroom tissue products, by conventional processing techniques, a dilute fiber furnish consisting of an aqueous slurry of hydrophilic papermaking fibers, e.g., cellulosic wood fibers, is dispensed onto a moving foraminous wire support by means of a headbox which uniformly distributes the fiber furnish across the width of the wire. Water drains through the support means, often aided by application of a vacuum applied to the underside of the wire, forming a wet web of fibers on the wire. The wet web is subsequently dried, and, if desired, the web leaving the drier may be creped on a Yankee dryer to impart additional bulk and softness to the product. Similar steps are also employed in the formation of stratified web products. U.S. Pat. No. 4,166,001 to Dunning et al., incorporated herein by reference, discloses a process for making a stratified single-ply fibrous web.

In the conventional single or multi-layer wet forming processes, the wet web, prior to a thermal drying step, is often wet pressed by means of consolidation rollers to remove a portion of the residual water from the wet web thereby reducing the heat load on the drier. As a consequence of wet pressing, a web of greater strength and density may be made, but the bulk of the product web is reduced. High bulk is desirable in many paper products to achieve softness and high liquid holding capacity.

Treated fibers useful in this process, i.e., kinked, bent, curled and otherwise distorted hydrophilic fibers, for example, natural cellulose fibers, may be obtained by various known chemical and mechanical treatment methods. For example, U.S. Pat. No. 2,516,384 to Hill, et al., discloses a wet treating method wherein conventional wood pulp fibers are wet worked into small, discrete nodules, which are then compressed and rolled to contort the fibers. U.S. Pat. No. 3,028,632 to Coghill, describes a machine for processing wood pulp according to the method of Hill, et al. When employed in conventional wet papermaking processes, the treated wood pulp fibers tend to lose their kinks and curls with the result that the bulk of the product web, as compared with webs produced from untreated fibers, is not enhanced to the expected extent, apparently because of the tendency of the wet treated fibers to revert to their original configuration with time as discussed in U.S. Pat. No. 4,036,679 to Back, et al.

Present practice in the manufacture of webs having enhanced bulk and softness is to treat the bulk enhancing fibers mechanically or chemically under conditions which produce essentially permanently kinked or curled treated fibers. In the process of U.S. Pat. No. 4,036,679, to Back et al., for example, cellulosic fibers are kinked and curled by defiberizing a pulp having a consistency of 60 to 90% fiber by weight in a high energy system, such as a disc refiner, to produce treated fibers which retain their kinks and curls for about 24 hours in an aqueous environment before relaxing to their original characteristic forms. An analogous process is described in U.S. Pat. No. 3,382,140 to Henderson, et al., wherein fibrillated kinked fibers are produced by refining at a consistency of between about 10 and 60% fiber by weight. An alternate approach is exemplified in U.S. Pat. No. 3,455,778 to Bernadin wherein the fibers are treated chemically to produce permanently kinked fibers which retain bulk enhancing properties when employed in conjunction with conventional wet laid technology.

It is also known that refining or conventional wet milling of papermaking fibers produces treated fibers containing kinks and curls of transient duration in an aqueous environment. The energy required for wet milling is generally not of the type and of the severity necessary to permanently kink the fiber.

In the process disclosed in U.S. Pat. No. 4,443,297 to Cheshire, et al., and in U.S. Pat. No. 3,716,449 to Gatward, et al., both incorporated herein by reference, conventional papermaking fibers are uniformly dispersed in a foam produced from an aqueous solution of a foamable water soluble surfactant, and the resulting aqueous furnish comprising fibers in foamed liquid is dispensed onto a moving foraminous support means.

The present invention provides a process for the manufacture of stratified fibrous webs of enhanced bulk in which treated hydrophilic fibers, characterized by kinks, curls, twists, crimps or like deformations are dispersed in an aqueous carrier, deposited on the forming wire, and dewatered in a period of time sufficiently short that the treated fibers preserve their bulk enhancing characteristics and impart improved softness and liquid holding capacity in the product web. In an aqueous environment, the degree of bulk enhancement of the product imparted by treated fibers is dependent upon the length of time the treated fibers are suspended in an aqueous carrier and the degree of agitation of the dispersion, as described and illustrated hereinafter.

In accordance with a preferred embodiment of the process of the present invention, treated hydrophilic fibers, characterized by kinks, curls, bends, twists or like deformations are dispersed in an aqueous foam which, due to its air content, minimizes water wetting and absorption which results in reversion of the treated fibers to their original form.

In a preferred embodiment of the process of the present invention, the treated kinked fibers as well as untreated conventional fibers are separately dispersed in a foamed liquid media comprising water, air and surfactant. Excess liquid draining through the foraminous forming means is collected and recycled in a closed loop system. The preferred foraminous forming surface is of the twin wire type, that is, two separate foraminous wires converging to form a nip, the furnishes being separately jetted into the nip from a forming header provided with a multi-slice injection nozzle. The wet web is then dried conventionally, the ultimate web product having a moisture content of about 5% water by weight. Standard processing treatments that may be performed on the web between forming and take-up on a parent roll include wet pressing, consolidation, embossing, and creping, each such operation being well known in the art of web manufacturing.

Figure 3:
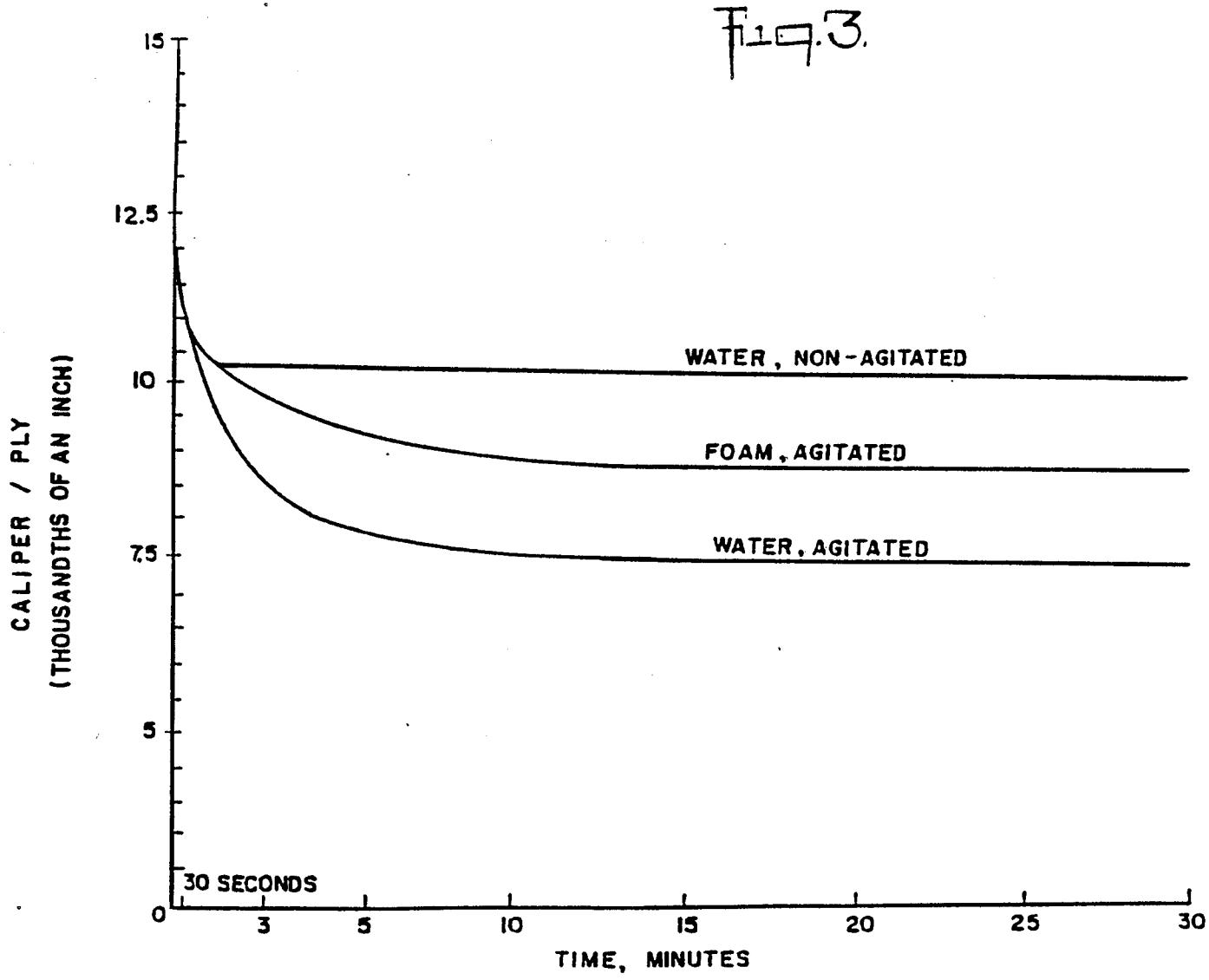

The process of this invention will be more fully described with reference to the accompanying drawings which illustrate preferred embodiments of the invention, wherein FIG. 1 is a simplified diagrammatic illustration, largely in flow-chart form, of an exemplary embodiment of the process of the invention;

FIG. 2 is an enlarged sectional view, simplified and not to scale, of a web produced by the process of FIG. 1; and FIG. 3 is a graphic illustration showing the relationships of time and environment on web product thickness or bulk for three furnish conditions treated dry fibers dispersed in non-agitated water, and in agitated foam and in agitated water, as so indicated.

Referring to FIG. 1 of the drawings, the invention will be described with reference to a preferred embodiment of the process of this invention for producing, by wet forming, a stratified single-ply paper web of relatively high bulk, wherein the central stratum consists essentially of fibers which have been treated to render them anfractuous and the outer strata are constituted of conventional papermaking fibers. It will be understood that this arrangement of strata is illustrative of a preferred embodiment and that, for example, one or both outer strata could be constituted of the treated fibers, and the central stratum could be constituted of conventional fibers. Other possibilities include blending conventional and treated fibers in one or more of the strata making up the single-ply composite web.

The starting material for both kinds of fibers can vary according to the desired web properties. Hydrophilic wood or similar cellulosic papermaking fibers are suitable for use in the process and make up the essential principal constituents of each layer of the composite web.

In accordance with a preferred embodiment of the invention, the fibers which are to constitute the central stratum of the product web are subjected to a mechanical deformation treatment step 12 rendering the fibers anfractuous. This process step can be performed in a number of ways, e.g., by a dry hammermilling operation, as disclosed more fully in our co-pending U.S. patent application, Ser. No. 409,055, now U.S. Pat. No. 4,488,932, of which this application is a continuation-in-part, by wet milling as in a chemifiner or double disc refiner, by chemical treatment or by a combination of these methods.

Conventional papermaking fibers, which constitute another stratum of the product web, are prepared in a conventional manner which may include, for example refining (not illustrated in the drawings), whereby the fibers may become fibrillated, but are not subjected to any special treatment to render them anfractuous. That is, the conventional papermaking fibers are ordinary conventional papermaking fibers which may be rendered transiently somewhat anfractuous during refining or other pre-forming operations but which do not retain that character to any significant degree in the formed and dried web. Such conventional fibers are made up into an aqueous furnish, by suspension in an aqueous carrier as described hereinafter.

In accordance with a preferred embodiment of the method of this invention, the two furnishes, respectively prepared in steps 15 and 16, are separately delivered to a three-slice headbox 18 which dispenses them simultaneously in alternating layers onto a moving foraminous wire support 20 of the twin-wire type comprising two endless moving forming wires 20A and 20B converging to form a nip 20C. The furnishes are supplied to the headbox under pressure and injected into the nip at a velocity in the range of 90 to 150 percent of the speed of the wire with the furnish prepared in step 15 supplied to and injected from the central slice of the headbox while the furnish prepared in step 16 is supplied to and injected from the two outer slices of the headbox. With foam forming, little mixing of fibers occurs in the nip and the separate foam furnishes form a stratified web 22 between the two wires 20A and 20B. The central stratum of the stratified web consists essentially of treated fibers which have been prepared in step 12 while the two outer strata (respectively located on opposite sides of the central stratum) are constituted of conventional papermaking fibers which have not been so treated. Again, it will be understood that the illustrated arrangement of furnish feeds supplied to the headbox may be modified, if desired, within the broad scope of this invention, to provide products in which the strata are differently arranged, for example, products wherein at least one outer stratum is constituted of fibers treated by step 12 and the central stratum is constituted of conventional wet papermaking fibers.

The forming wires are driven at a speed in the range of from about 1000 feet per minute (fpm) to about 7000 fpm, typically at about 2500 fpm with the tension of the wires in the range of about 20 pounds per linear inch (20 pli) to about 60 pli, typically about 30 pli. Furnish is supplied from steps 15 and 16 at rates sufficient to achieve a jet velocity from each of the slices of the headbox into the nip of the forming wires of from about 90% to 110% of the speed of forming wires. Preferably the velocity of the jets are about equal to the speed of the forming wires.

The formed web 22 is carried between the wires 20A and 20B around an impervious roll 24 while aqueous furnish medium expressed from the web drains through wire 20B into a conventional saveall 26 for collection and ultimate reuse in furnish preparation, as is customary in a closed-loop papermaking system. From the point at which the wires diverge, the web is transported on the wire 20A past vacuum box 28 to further conventional water removal or drying stages (not shown) with or without compaction. As shown in cross section in FIG. 2, the final, dry web product of this specific example is a single stratified ply 30 comprising a central stratum 31 of anfractuous fibers and outer strata 32A and 32B of conventional papermaking fibers.

It will be appreciated that various wholly conventional operations, employment of which will be apparent to persons of ordinary skill in the art, have been omitted (for the sake of simplicity) from the foregoing description of the process of the invention, and from the drawing. Among such operations are various aspects of furnish make-up, recycling and replenishment of liquid media, deflaking, etc., all of which are known in the art.

Further details of exemplary embodiments of particular features and steps of the present process are set forth below, by way of specific illustration of the invention.

The conventional papermaking fibers which are incorporated in the furnish prepared in step 16 of the above-described process, and which in consequence constitute the outer strata 32A and 32B of the produced web 30, comprise conventional papermaking fibers commonly used in the art of manufacturing paper towels, facial and toilet tissue, and similar fibrous webs. Typically, such conventional fibers are natural cellulosic fibers, such as those obtained from wood pulp, cotton, hemp, bagasse, straw, flax and other plant sources. Both hardwood and softwood pulp fibers may be used in the process, fiber lengths generally ranging from about 1.0 to 6.0 mm., the softwood pulps generally having longer fiber lengths than hardwood pulps. The pulps may be obtained from any of the conventional processes for preparing such fibers, for example, groundwood, cold soda, sulfite, or sulfate pulps, thermomechanical pulps (TMP) and chemically treated thermomechanical pulps (CTMP), and may be bleached or unbleached.

In addition to the wood pulp fibers synthetic fibers, such as polyester, polypropylene, polyethylene, polyamide, and nylon fibers, as well as chemically modified cellulosic fibers such as rayon, cellulose acetate, and other cellulose ester fibers may be blended with the wood fibers. Synthetic and modified natural fibers are now commonly used in the manufacture of fibrous webs, either alone or in combination with natural cellulosic fibers when specific attributes of the product web are desired. For example, a blend of synthetic and natural cellulosic fibers is advantageous to obtain a multiuse, ultimately disposable, industrial wipe. The conventional papermaking fibers incorporated into the webs of the present invention are hydrophilic, although some hydrophobic fibers may be blended into either furnish, preferably into the furnish forming the outer strata for improved tensile strength of the product web. Softwood fibers are desirable in the product web for the same reason, i.e. increased tensile strength.

The fibers which are treated in step 12 of the abovedescribed process and incorporated in the furnish prepared in step 15 to constitute the central stratum 31 of the produced web consist essentially of non-fibrillated hydrophilic papermaking fibers. Hence, the class of treated, i.e. anfractuous, fibers includes all of the natural cellulose fibers referred to above as well as chemically modified cellulosic ester fibers, which fibers are generally considered hydrophilic when the degree of substitution of hydroxyl groups present therein is less than about 1.0. The plurality of intorsions present among the treated fibers provides said fibers with three dimensional characteristics not present substantially in the first class of conventional (untreated) fibers which are structurally ribbon-like. When laid in a web the conventional fibers tend to lie flat within the web along the x-y plane. Conversely, the treated fibers are randomly distributed three dimensionally within the web. That is, there is substantial penetration of the treated fibers into the plane of the web (the z plane).

The treated fibers are further characterized in that the degree of treatment is sufficient to create the kinks, curls and other intorsions, yet is not so severe that the fibers become permanently kinked. Thus, because the treated fibers are hydrophilic, they tend to return to their original shape in a relatively short time after they are slurried in an aqueous medium. The rate of relaxation of these relatively short-lived intorsions is relatively rapid during the first few minutes after they are wet with water, but is dependent on a number of factors including the severity of treatment during preparation, the consistency of the slurry, the presence or absence of agitation, the severity and nature of said mixing (if any), the temperature of the aqueous medium, the presence of wetting agents, and the like. However, even under essentially ideal conditions of no agitation and ambient temperature, but at conventional process utilization consistency, i.e., consistencies less than about 10% by weight, the intorsions relax considerably during a period of about 1 to about 10 minutes in a water environment. Conventional web manufacturing methods, which require pulping and storage operations that extend over several hours, typically one to six hours with vigorous agitation, are thus not suited to use with many of the treated fibers utilizable in the present invention.

Preferably, the mechanical treatment step 12 of the present process, to which non-fibrillated conventional papermaking fibers are subjected so as to undergo mechanical deformation and to be rendered anfractuous, is a dry hammermilling operation. Alternatively, although less desirably, a wet milling treatment of the general type disclosed in U.S. Pat. No. 2,516,384 (Hill, et al.) or U.S. Pat. No. 3,028,632 (Coghill) may be employed.

The preferred means for preparing the treated fibers in step 12 is to defiberize dry laps in a hammermill. As used in the preceding sentence, the term "dry" means that no free water is present in the fibers, although the laps, bales or the like will normally contain as much as about 15% equilibrium moisture by weight as a result of storage under atmospheric conditions.

The intorsions provided by a hammermill are occasioned predominantly by the forces upon the fibers as they pass between the anvil and rotating hammers. When cellulosic treatable fibers are conditioned in this manner, elevated temperatures within the hammermill, usually in the range of 150 to 210° F., resulting from the dissipation of mechanical energy as thermal energy, enhance the effect produced by the mechanical beating forces alone by eliminating some hydroxyl groups associated with the cellulose, and thus introducing additional constrictive and contortive forces upon the individual fibers.

It is a requisite that the means employed in mechanical treatment step 12 to prepare the fibers not fibrillate them to any substantial degree. The presence of fibrils is antithetical to the bulk enhancement properties of the fibers.

A preferred wet milling apparatus is a "Chemifiner" machine manufactured by Black Clawson Corporation. In the "Chemifiner" machine, fiber curling and kinking is accomplished by subjecting a nodular mat of pulp to gyratory motion under compression between a driven disk and a hydraulically loaded eccentrically opposed "floating" disk rotating in the same direction at nearly the same speed. The patterned faces of the disks provide tractive surfaces so that the pulp nodules are continuously re-oriented as they roll and traverse from the center inlet port to the peripheral discharge zone. In an illustrative specific example of such treatment, producing suitable anfractuous fibers, pulp consistency is between 35 and 37% by weight. The hydraulic loading pressure is about 40 p.s.i. (gauge), while the floating disk rotates at a speed of between 100 and 500 ft./min. An eccentricity of 0.075 inch is used. Initial disk clearance is about 0.040 inch, and operating temperature is about 140–150 F.

In a preferred embodiment of the process the treated fibers from step 12 are made up into a furnish (step 15) with a foamed aqueous medium, generally in accordance with the process disclosed in U.S. Pat. No. 4,443,297 to Cheshire, et al., in which papermaking fibers are uniformly dispersed in an aqueous solution of a foamed water-surfactant solution and the foamed liquid containing the fibers under pressure is dispensed into the nip of a twin wire papermaking machine. The forming medium or aqueous carrier, is a foamed dispersion comprising air, water and surfactant in which the air content of the foam at atmospheric pressure is maintained within the range of 55 to 75 percent by volume. As an illustrative example of such procedure, the treated fibers are initially mixed with the foamed medium under conditions of relatively low agitation to a consistency of between about 0.3 and about 4 percent fiber by weight, based on the dry weight of the fiber, and then further diluted, as required, with foam to a consistency of about 0.3 to about 1.2 percent fiber by weight, transported to the headbox 18, and dispensed onto the moving foraminous support 20.

The residence time of the treated fibers in contact with aqueous medium after the mechanical treatment is desirably kept relatively short, e.g., no greater than about five minutes, and preferably three minutes or less to minimize relaxation of the anfractuous fibers. For maximum bulking, deflaking of the furnish, if employed, is performed within these time limits. Agitation required to disperse the treated fibers in the foamed aqueous medium is performed rapidly with a mild agitation to minimize wetting and relaxation of the fibers. The furnish temperature is preferably maintained within the range of about 60 to about 120 F., suitably at about ambient temperature to minimize relaxation of the fibers, the relaxation rate tending to increase as the temperature of the furnish increased.

The foamed liquid may be prepared by passing foamable liquid repeatedly through the forming cycle, with or without the addition of fibers to the foamable liquid. Foam drained from the wires is recycled from the saveall 26 to furnish preparation step 15.

The properties of the foam are dependent on air content, ranging between 55 and 75% by volume; the bubble size, ranging between 20 and 200 microns in diameter, and the surfactant selection. The surfactant may be anionic, non-ionic, cationic or amphoteric, provided it has the ability to generate a foamed dispersion. A preferred anionic surfactant is an alpha olefin sulfonate marketed under the trade name "Ultrawet A-OK," by Arco Chemical Company, Philadelphia, while a preferred non-ionic surfactant is a PEG-6 lauramide, marketed under the trade name "Mazamide L-5AC" by Mazer Chemical Co., Chicago. The concentration of surfactant in the solution is in the range of about 150 to 450 ppm (parts per million) by weight, and is adjusted as required to maintain the desired properties of the foam.

Although the above-described furnish preparation using a foamed medium represents a preferred mode of practice to optimize retention of fiber contortions and also because the use of a foamed medium itself tends to enhance product web bulk, it is also possible to use plain water (without air bubbles or surfactant) to make up the furnish in steps 15 and 16 provided that the residence time of treated fibers in the water furnish is sufficiently small to preserve the anfractuous characteristics of the treated fibers.

In a preferred embodiment of the invention, the web is wet-formed in a twin-wire former having a three-slice headbox 18 with the furnish prepared in step 15 supplied to the central slice of the headbox and the furnish prepared in step 16 supplied to the two outer slices, i.e., on either side of the central slice. The headbox is arranged to continuously inject concurrent jets of the furnishes from the three slices into the nip 20C between the wire supports 20A and 20B, depositing the furnishes in alternating layers (step 16 furnish/step 15 furnish/step 16 furnish) on the foraminous wire supports, to form the wet web 22. Three-slice or three-channel headboxes are known in the art, being described, for example, in U.S. Pat. Nos. 4,086,130 to Justus and 4,166,001 to Dunning, et al. Although the web is produced as a single ply, the laminated single ply web may be employed in conventional manner to produce products constituted of two or more plies.

Although the web produced as described is made up as a central stratum of treated fibers (T) between outer strata of conventional fibers, i.e., a C-T-C arrangement, other arrangements having at least one stratum of each are equally within the scope of the invention (e.g. C-C-T, C-T-T, and T-C-T) and can be formed by the described procedure by appropriate arrangement of the supply of the two furnishes to the several slices of the headbox.

We have found that the formation of a three-layer stratified ply wherein at least one stratum consists essentially of treated (anfractuous) fibers and at least one other stratum comprises conventional (untreated) papermaking fibers results in greater bulk enhancement of the dried product web as compared with webs of like fiber content wherein the anfractuous and untreated fibers are commingled in a single layer or stratum. The use of a foamed furnish further enhances the bulk of the dried product web.

We claim:

1. In a process for production of a fibrous web towel or tissue product of enhanced softness, absorbency and bulk, the steps comprising:

(a) forming treated dry cellulosic papermaking fibers characterized by twists, kinks, curls, crimps, or the like by dry hammermilling wood papermaking fibers without substantial fibrillation or breakage of the fibers;

(b) preparing an unfoamed aqueous furnish by dispersing said dry treated papermaking fibers in water;

(c) depositing a layer of fibers from said furnish onto a moving foraminous support forming a fibrous web; and (d) removing water from the fibrous web within a period of time not greater than about five minutes after the time of initial contact of the treated dry fibers with the water.

2. A process according to claim 1 wherein the water is removed from the web within a period of time not greater than about three minutes from the time of initial contact of the treated dry fibers with the aqueous carrier medium.

3. The process according to claim 1 wherein the furnish temperature is within the range of 60 to 120 degrees Fahrenheit.

4. A process according to claim 1 wherein the wet web is pressed by means of consolidation rollers to remove water therefrom prior to drying.

5. A process according to claim 1 wherein the aqueous furnish is made up of a blend of hammermilled dry fibers and natural papermaking fibers.

6. A process as defined in claim 1 wherein the furnish of hammermilled papermaking fibers and a separate aqueous furnish having a fiber content consisting essentially of natural cellulosic wood papermaking fibers are deposited on the foraminous support in laminar relationship to one another forming a single ply bonded web.

* * * * *